US005329963A

United States Patent [19]

Jones et al.

[11] Patent Number: 5,329,963

[45] Date of Patent: Jul. 19, 1994

[54] METHOD OF AND APPARATUS FOR PACKAGING A BEVERAGE IN A CONTAINER

[75] Inventors: Michael E. Jones, Barsted; Andrew J. Kenward, London, both of Great Britain

[73] Assignee: Guinness Brewing Worldwide Limited, London, Great Britain

[21] Appl. No.: 957,727

[22] Filed: Oct. 7, 1992

[30] Foreign Application Priority Data

Oct. 8, 1991 [GB] United Kingdom ..... 9121375

[51] Int. Cl.[5] ..... B67C 3/06

[52] U.S. Cl. ..... 141/6; 141/39; 141/48; 141/92; 141/63

[58] Field of Search ..... 141/6, 11, 39, 48, 92, 141/63; 53/425, 432, 510

[56] References Cited

U.S. PATENT DOCUMENTS

| | | | |
|---|---|---|---|
| 2,770,263 | 11/1956 | Breeback | 141/48 X |
| 3,486,538 | 12/1969 | Quest et al. | 141/48 X |
| 3,886,982 | 6/1975 | Uth et al. | 141/39 |
| 4,124,043 | 11/1978 | Noguchi | 141/6 |
| 4,360,045 | 11/1982 | Ahlers | 141/39 |
| 4,390,048 | 6/1983 | Zelder | 141/6 |
| 4,442,873 | 4/1984 | Yun | 141/39 |
| 4,832,968 | 5/1989 | Forage et al. . | |
| 5,054,527 | 10/1991 | Rozier | 141/39 |

FOREIGN PATENT DOCUMENTS

| | | | |
|---|---|---|---|
| 2218079 | 7/1987 | European Pat. Off. . | |
| 1266351 | 3/1972 | United Kingdom . | |
| 227213 | 11/1989 | United Kingdom . | |
| 2217696 | 11/1989 | United Kingdom | 141/63 |
| 2218078 | 11/1989 | United Kingdom . | |

*Primary Examiner*—Ernest G. Cusick

[57] ABSTRACT

A can (1) has a primary chamber and a secondary chamber in communication through a restricted orifice and its exterior maintained at atmospheric pressure. The can (1) is filled with beer through a filling block (24) from a bowl (8). Prior to filling the can (1) is pressurized through the block (24) with nitrogen gas to greater than atmospheric pressure and subsequently evacuated to atmospheric pressure. Such pressurization and evacuation is repeated sequentially to dilute the atmospheric oxygen content within the primary and secondary chambers. A gas exchange conduit (40) extends between the bowl headspace (12) and the can (1). Conduit (40) has a gas control valve (55) closeable by movement of lever (60). A beer flow valve (37/46) controls flow of beer (9) from the bowl. During nitrogen pressurization of the can (1) the lever (60) is adjusted to maintain valves (55) and (37/46) closed and insure that high pressure gas in the can (1) cannot flow through conduit (40) into the bowl (8).

16 Claims, 5 Drawing Sheets

METHOD OF AND APPARATUS FOR PACKAGING A BEVERAGE IN A CONTAINER

TECHNICAL FIELD AND BACKGROUND ART

The present invention relates to a method of and an apparatus for packaging a beverage in a container. More particularly the invention concerns the packaging of a beverage (which may be alcoholic or non-alcoholic) in a sealed container, the atmosphere of which is relieved of oxygen to alleviate deterioration of the beverage by oxidation.

The invention was primarily developed for the packaging of beer such as ale, stout or lager which is sealed in a container to provide a headspace containing nitrogen and/or carbon dioxide at a pressure greater than atmospheric. In the brewing industry it is recognized that the packaging of beer in the presence of atmospheric oxygen can rapidly cause oxidation of the beer and unacceptable deterioration of its desirable characteristics. Consequently precautions are taken to insure that the contamination of beer by oxygen is alleviated during the filling and sealing stages of the container. One well known precaution in a simple beer packaging line is to purge open topped containers (such as light metal cans) of oxygen by flushing the containers with nitrogen gas immediately prior to the container being charged with beer and sealed.

In a beverage package which we have developed and which has met with considerable commercial success, a sealed container has a primary chamber charged with beverage containing gas in solution and a smaller secondary chamber which communicates with the primary chamber by way of a restricted orifice. The secondary chamber contains gas at pressure greater than atmospheric while a headspace is provided in the primary chamber also containing gas at a pressure greater than atmospheric. Upon opening of the container, a pressure differential is created causing gas and/or liquid in the secondary chamber to be ejected by way of the restricted orifice into the beverage in the primary chamber to liberate gas from solution and develop a head or froth on the beverage in the primary chamber. The secondary chamber may be formed integrally with the container or as a hollow insert which is placed within the container. Examples of beverage packages having the aforementioned secondary chamber are disclosed in our European Patent Specification A-227,213 and our British Patent No. 1,266,351.

While the aforementioned flushing with nitrogen gas may purge the primary chamber of atmospheric oxygen, because of the restricted orifice between the primary and secondary chambers such flushing as occurs in a high speed packaging/filling line has negligible effect on the oxygen content in the atmosphere of the secondary chamber. As a consequence elaborate techniques and facilities have been developed for use in a beverage packaging line by which it may be insured that atmospheric oxygen is removed from both the primary and secondary chambers prior to the containers being charged with beverage; examples of these techniques are disclosed in our British Patent Specifications 2,218,078A, 2,218,079A and 2,217,696A.

In the aforementioned prior proposals the container, particularly its primary and secondary chambers, is subjected to a sequence of pressure changes to replace the atmospheric oxygen in the primary and secondary chambers with nitrogen gas. More particularly, the container is sealed to a vacuum source and the primary and secondary chambers initially evacuated; following evacuation of the atmosphere, nitrogen gas is introduced into the primary and secondary chambers of the container and if necessary these steps of evacuation and nitrogen gas introduction can be repeated successively to ensure that nitrogen gas is substituted for the original atmosphere in both the primary and secondary chambers. During evacuation of the container its walls may be subjected to a considerable pressure differential which, in the case of fragile or thin walled containers can cause the container to collapse or implode. Modern packaging containers for beverage are frequently of a structure which, if subjected to evacuation by a vacuum pump, would rapidly collapse at very little pressure differential between the sub-atmospheric pressure in the primary and secondary chambers of the container and atmospheric pressure outside the container—this is especially true of light alloy thin walled cans which are currently favored for the packaging of beverages. To alleviate this problem our aforementioned prior Patent Specifications propose that containers which are liable to collapse during evacuation are located in a pressure chamber by which the interior, that is the primary and secondary chambers, and the exterior of the container are subjected to substantially the same pressure variations during the evacuation and nitrogen gas introduction stages. However, the pressure chambers tend to be relatively bulky and occupy considerable space in a beverage filling line where, typically but not necessarily, there will be forty package locating stations each with a beverage filling head and pressure chamber to accommodate a conventional 500 milliliter beverage can. These stations are spaced along the circumference of a rotary table which carries each can successively through its gas exchange and beverage charging stages. For a given sized rotary table, the space occupied by the pressure chambers restricts the number of can locating stations which can be provided and therefore the rate at which the cans can be processed through the gas exchange and filling stages. Also, of course, the pressure chambers together with appropriate controls for opening and closing those chambers about the respective containers adds significantly to the overall cost of the packaging equipment.

It is an object of the present invention to provide a method of and apparatus for packaging beverage in a container and by which the aforementioned disadvantages associated with the prior proposals for containers of the kind discussed (those having primary and secondary chambers which communicate with each other by way of a restricted orifice) may be alleviated so that an atmosphere having a reduced oxygen content can be provided in a thin walled or fragile container without risking collapse or implosion of the container and without requiring the container to be located in a pressure chamber.

STATEMENT OF INVENTION AND ADVANTAGES

According to the present invention there is provided a method of packaging a beverage in a container having a primary chamber and a relatively smaller secondary chamber which communicates with the primary chamber by way of a restricted orifice which comprises the steps of (a) subjecting the interior of the container and thereby the primary and secondary chambers to a pressure greater than atmospheric pressure by admission thereto of a non-oxidizing gas, (b) reducing the pressure of gases in the interior of the container to substantially atmospheric pressure to dilute the atmospheric oxygen content within the primary and secondary chambers to a predetermined percentage by volume of the gases within the container and which oxygen content is substantially negligible in its effect, if any, on the beverage which is to be sealed in the container, (c) charging the interior of the container with said beverage and (d) sealing the container to provide a beverage package; and which further comprises throughout said steps maintaining the exterior of the container at atmospheric pressure and the interior of the container at not less than atmospheric pressure.

Preferably steps (a) and (b) of the method are repeated at least once to progressively dilute the atmospheric oxygen content within the primary and secondary chambers to said predetermined percentage.

Further according to the present invention there is provided apparatus for packaging a beverage in a container having in its interior a primary chamber and a relatively smaller secondary chamber which communicates with the primary chamber by way of a restricted orifice and which comprises a station for mounting an open mouthed container with the interior and exterior of the container at atmospheric pressure; a head which is displaceable relative to the container into sealing engagement with the mouth of the container to communicate with the interior thereof; gas control means by which a non-oxidizing gas (preferably nitrogen) is admitted at a pressure greater than atmospheric pressure through said head into the interior of the container; means controlling evacuation or exhaustion of the interior of the container through said head for reducing the pressure of gases within the primary and secondary chambers of said container from said pressure greater than atmospheric to substantially atmospheric pressure whereby the oxygen content within the primary and secondary chambers from its original atmosphere is reduced to a predetermined percentage by volume of the gases within the primary and secondary chambers of the container for said oxygen content to be substantially negligible in its effect, if any, on the beverage which is to be packaged in the container. Preferably control means is provided for successively and sequentially admitting said non-oxidizing gas to the interior of the container at the pressure greater than atmospheric and evacuating or exhausting the primary and secondary chambers to reduce the gases provided therein from said pressure greater than atmospheric to substantially atmospheric pressure.

By the present invention it is not envisaged that all of the atmospheric oxygen which is initially present in the atmosphere of the open topped container will be removed and exchanged for the non-oxidizing gas (such gas will hereinafter be considered as nitrogen although other gases appropriate for beverage foodstuffs may be used such as argon or carbon dioxide). However, it is intended that the oxygen gas contained in the original atmosphere of the container is diluted by the successive stages of admitting nitrogen gas under pressure greater than atmospheric and evacuating or exhausting the pressurized gases so that such oxygen as may remain, particularly in the secondary chamber, is negligible in its effect on the beverage in the sealed container over, what may be regarded as, a reasonable shelf life for the beverage package. While conventional thin walled light metal alloy beverage cans readily collapse under atmospheric pressure when their interior is evacuated, such cans may withstand considerable internal pressure before suffering from unacceptable deformation or bursting. For example, thin walled 500 milliliter metal alloy cans as are currently popular for packaging beverage can usually withstand up to 6 atmospheres internal pressure while the exterior is at atmospheric pressure before exhibiting excessive deformation or rupturing. Consequently, it is to be expected that such conventional cans may be pressurized internally with nitrogen gas to, say, 4 bars, while the exterior of the can is at atmospheric pressure and provide an appreciable safety margin; the cans are then exhausted to atmospheric pressure to dilute the content of atmospheric oxygen originally present in them. By repeating the aforementioned pressurization and exhaustion stages once or several times as is preferred, it will be appreciated that the atmospheric oxygen content can progressively be reduced to a percentage of the mixed gases (following the, or the final, exhaustion step) which is considered insignificant in its effect on the beverage which is to be packaged and sealed in the container for what may be regarded as an acceptable shelf life for the beverage. For a beer package a reasonable shelf life, typically, is considered as nine to twelve months and it has been found that an oxygen content up to approximately 0.5 milligramms of oxygen per liter of beer (approximately 0.5 parts of oxygen per million) can be present without causing unacceptable changes in the desirable characteristics of the beer over the aforementioned shelf life—in practice an oxygen content not exceeding 0.3 milligramms per liter is preferred to ensure a longer shelf life beyond that regarded as reasonable and such a reduction in the oxygen content can readily be achieved by the present invention.

Prior to the container being initially pressurized with nitrogen gas to, say, 4 bar as previously mentioned, it is preferred that the interior of the container is subjected to flushing with nitrogen gas whereby the interior of the container is open to atmospheric pressure and nitrogen gas flushed therethrough. This serves to exchange the air in the primary chamber for nitrogen gas in a similar manner to conventional purging of containers but this initial purging is likely to have negligible effect on the air contained in the secondary chamber because of the restricted communication presented by the orifice between the primary and secondary chambers. Nevertheless, by the initial exchange of air for nitrogen gas in the primary chamber, it will be appreciated that the subsequent pressurization with nitrogen gas and exhausting stages in accordance with the present invention will promote the rate at which the oxygen content in the secondary chamber is reduced.

Preferably the head which moves into sealed engagement with the mouth of the container and through which head internal pressurization of the container with nitrogen gas and exhaustion of the gases to, substantially, atmospheric pressure (and possibly initial nitrogen gas flushing) is effected is a filling head having a nozzle through which beverage is admitted to the primary chamber of the container following the, or the final, evacuation or exhaustion stage. The filling head is preferably provided with beverage from an overlying bowl or reservoir in which the beverage is maintained with a headspace of nitrogen gas at a pressure greater than atmospheric, typically 2 bar. Valve means control fluid flow (that is liquid and/or gas) communication between the bowl or reservoir and the interior of the container. In particular, admission of beverage from the bowl into the primary chamber of the container is controlled by a beverage flow valve which may open against the pressure of beverage in the bowl. Extending between the headspace of the beverage in the bowl and the interior of the container is a gas exchange conduit having a gas control valve (usually located in the bowl) which valve, when open, provides communication through the conduit between gas in the headspace of the bowl or reservoir and the gas in the container. Following the final pressurization and exhaustion stages in accordance with the present invention and with the interior of the container substantially at 1 bar or atmospheric pressure, the gas control valve is opened so that nitrogen gas in the headspace of the bowl at, say, 2 bar pressure flows into the container to equalize the pressure in the container with that in the bowl headspace. As a consequence of this equalization the beverage flow valve reacts and opens to permit beverage flow from the bowl into the primary chamber of the container. While the container is being charged with beverage the headspace formed thereby progressively reduces and gas from the headspace in the container flows by way of the gas exchange conduit and the gas control valve into the headspace of the bowl. When a predetermined level of beverage is attained in the container, the gas flow from the container, or possibly the level of beverage in the container, causes a normally open second gas control valve, conveniently a ball valve, in the gas exchange conduit to close and prevent gas flow from the container headspace into the bowl headspace. As a consequence to the fact that gas cannot escape from the headspace in the container, a back pressure develops and beverage flow into the container ceases. In addition, control means can be provided to close the beverage flow control valve at the appropriate stage of filling. The filling head as above described is well known for beer filling lines and is discussed in detail in the Specifications of our previously mentioned British Patent Applications. However, a preferred feature of the apparatus of the present invention where the pressurization with nitrogen gas and exhaustion of the container prior to filling is effected through the filler head is that retaining means is provided which insures that the first mentioned gas control valve remains closed (to shut off communication between the interior of the container and the headspace of the beverage in the bowl or reservoir) and, preferably, insures that the beverage flow control valve remains closed during the nitrogen gas pressurization stages of the container prior to filling. This is to alleviate the possibility that when the container is pressurized with nitrogen to a pressure greater than that in the headspace of the bowl, typically 4 bar as compared with 2 bar, nitrogen gas will not flow from the container and by way of the gas exchange conduit and the gas control valve into the headspace in the bowl to disrupt the balance in the system and adversely affect the efficiency of the oxygen dilution stages. Preferably the retaining means also maintains closed the beverage flow control valve as aforementioned to insure that such valve is not lifted from its seat during nitrogen pressurization of the container and permit nitrogen gas from the container to enter the beverage in the bowl.

DRAWINGS

One embodiment of a beverage packaging apparatus constructed in accordance with, and utilizing the method of, the present invention will now be described, by way of example only, with reference to the accompanying illustrative drawings in which:

FIG. 1 is a plan view of the apparatus diagrammatically illustrating successive stages through which containers pass for air purging, pressurizing, exhausting and beverage filling;

FIG. 2 diagrammatically shows a diametral section of the apparatus;

FIG. 3 shows, in section, one of several beverage filling heads and gas control system therefor included in the apparatus;

FIG. 4 diagrammatically illustrates the location of the filler head shown in FIG. 3 with a beverage bowl of the apparatus and shows a control/retaining device for valves in the filling head, and FIG. 5 diagrammatically illustrates the operation of the valve control/retaining device in FIG. 4 and shows a side elevation of that device on the table.

DETAILED DESCRIPTION OF DRAWINGS

Figure 1:
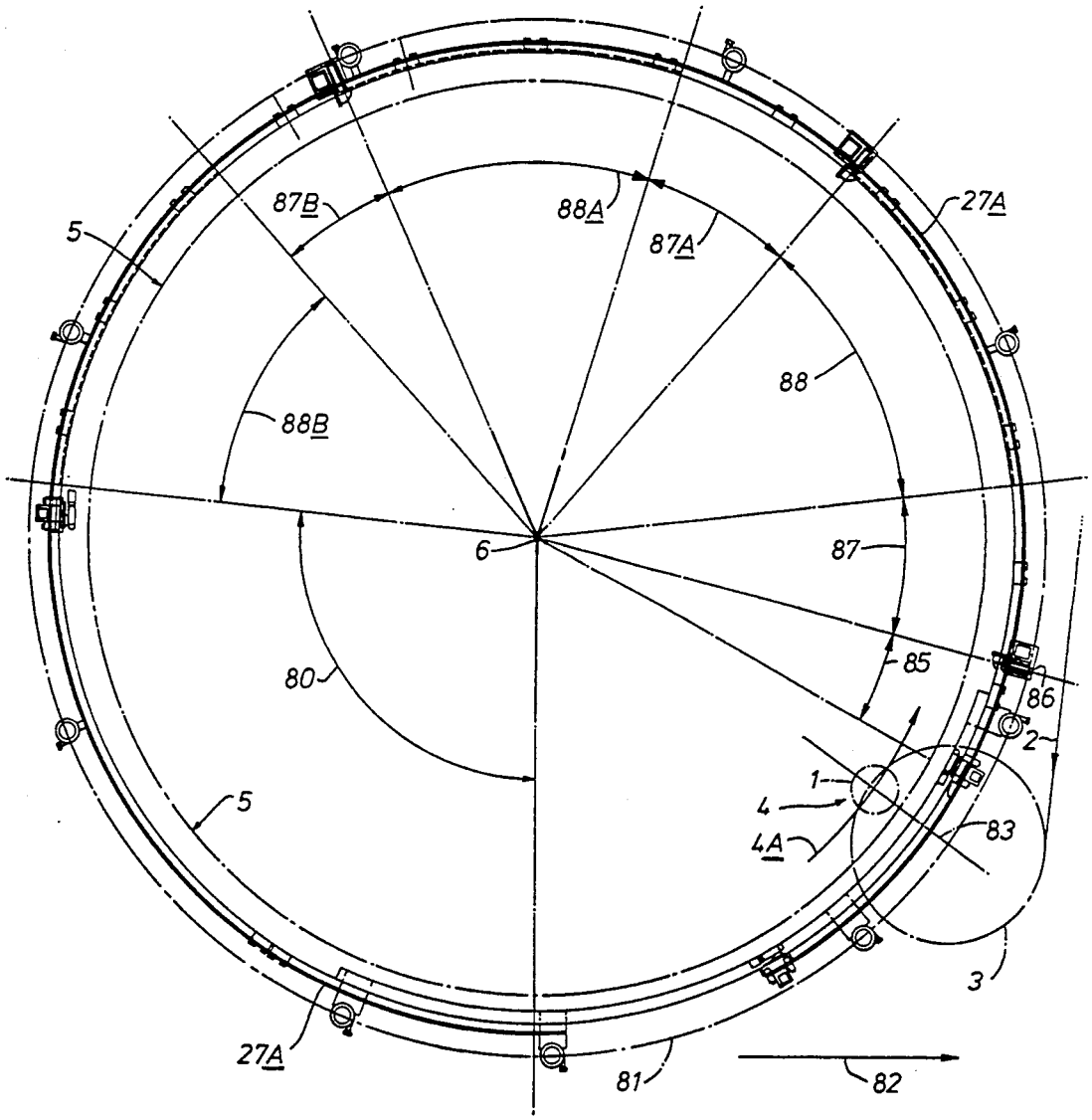

The apparatus in the present example will be considered in relation to the packaging of beverage such as beer in a thin walled light metal alloy cylindrical container or can 1 which is fed to the apparatus in an upstanding condition and with the top of the container open. Before approaching the apparatus the interior of the can, which forms a primary chamber, is fitted with a hollow insert 1A which provides a secondary chamber that communicates with the primary chamber by way of a restricted orifice. An example of such a container fitted with the hollow insert is disclosed in our European Patent Specification No. 227,213A and the beverage package which is to be formed by use of the apparatus of the present invention may conveniently be considered as a package similar to that disclosed in the aforementioned European Specification. Many of the features in the exemplified apparatus are known in the beverage packaging art and we would recommend reference to our British Patent Specification A-2,217,696 for a discussion of such features.

An array of upstanding open topped cans 1 with the hollow inserts 1A fitted are fed by a conveyor 2 (in FIG. 1) to a star wheel 3 by which the cans are displaced from the conveyor successively into work stations 4 on a substantially horizontal, annular platform 5. The platform 5 rotates on a central core 11 continuously about its axis 6 in an anti-clockwise direction in FIG. 1. In the present embodiment 120 work stations 4 are equally spaced circumferentially on the platform 5. In FIG. 2 two diametrically opposed work stations 4 are illustrated and it will be seen that each can 1 is firmly accommodated on a seat 7 in its respective work station to be carried with that work station along a circular path 4A (FIG. 1) concentric with the axis 6.

Overlying the annular table 5 and concentric therewith is an annular chamber 8 of rectangular section which provides a bowl or reservoir of beer 9 from which the cans 1 are to be charged. The beer 9 within the bowl 8 is maintained at a substantially constant depth and is replenished as the containers are filled by supply lines 10 from and through the central core 11 of the apparatus. A headspace 12 in the bowl 8 contains nitrogen gas at a pressure greater than atmospheric, say approximately 2 bar, and is maintained by a gas supply line 13 which branches off a main nitrogen line 14 from a nitrogen supply 14B in the central core 11. The line 14 also supplies nitrogen gas under pressure to a manifold 14A on a side wall 8A of the bowl 8 and by way of a line 13A to a ring main supply for a control valve assembly 13B for each work station. The assembly 13B comprises a set of three valves 13B', 13B'' and 13B''' operation of each of which is controlled as required by engagement with localized cams during rotation of the bowl 8. The bowl 8 is mounted above the platform 5 and rotates in unison therewith and consequently appropriate rotating sealed connections are provided between the rotating lines 10 and 14 and the respective sources of supply, for example in a rotary union 11A in the central core 11.

Carried by the wall of the bowl 8 for rotation therewith are a circumferentially spaced array of 120 filling heads 20 which are associated one with each work station 4 and overlie the open tops of the containers 1 on the seatings 7 of the respective work stations 4.

Figure 3:
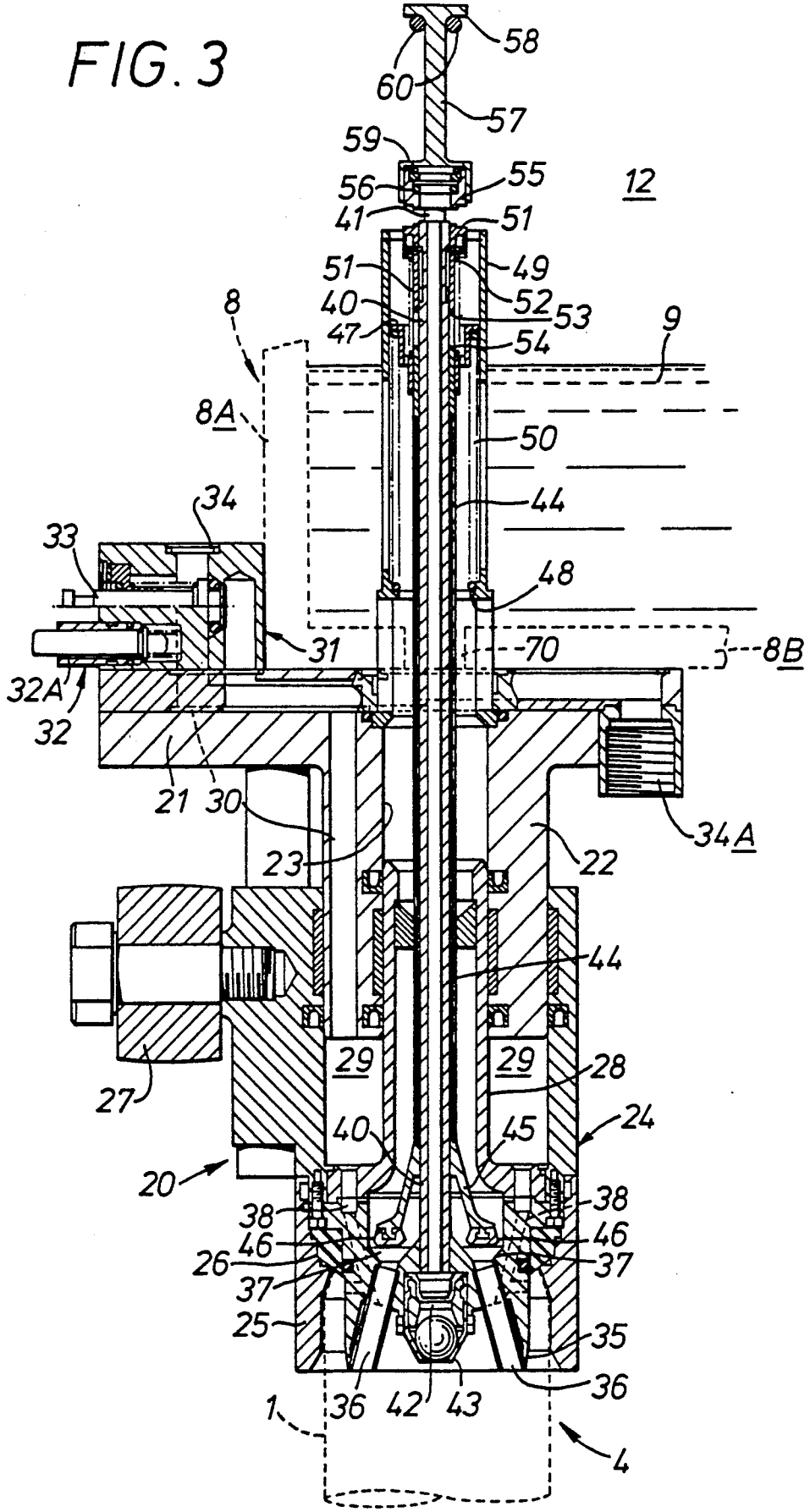

A filling head 20 is best seen in FIG. 3 and comprises a mounting plate 21 secured to an underside wall 8B of the bowl 8 and from which plate projects a downwardly extending cylindrical spigot 22 having a co-axial cylindrical bore 23. Axially slidable on, and in sealed engagement with, the spigot 22 is a head block 24 at the bottom end of which is carried a downwardly opening annular skirt 25 that is to receive the open upper end of the can 1 on the seat 7 associated with the respective work station. The skirt 25 includes an annular seal 26 which is to effect sealing engagement with the rim of the can top opening.

Throughout their rotation on the annular platform 5 the cans are maintained in the same horizontal plane. To permit this the head block 24 is slidable vertically along the cylindrical spigot 22 under control of a cam track 27A (FIG. 1) acting on a roller 27 carried by the head block so that the skirt 25 and its seal 26 can move into and out of engagement with the can top. During displacement of a can 1 onto a seat of a work station 4 it will be apparent that the head block 24 is displaced by the cam track and roller 27 upwardly to provide clearance for accepting the can on the seat 7 and that during unified rotation of the platform 5 and bowl 8 the head block 24 is lowered under control of the cam track and roller 27 for the skirt 25 to receive the upper end of the can 1 with the rim of the latter sealing against the seal 26. To provide clearance for eventual displacement of the can 1 from the platform 5, the head block 24 is again raised out of engagement with the can.

Located within the head block 24 and forming part of that head block is a tubular cylindrical spigot 28 which is slidably received, in sealed engagement, within the bore 23 of the spigot 22. An annular chamber 29 about the spigot 28 is formed within the head block 24 at the bottom end of the spigot 22. The chamber 29 communicates by way of passages 30 within the spigot 22 and mounting plate 21 with a valve block 31 mounted on the plate 21. The valve block 31 includes spring loaded spool valves in the form of a snift valve 32 and an exhaust valve 33 which are actuated by the cam tracks 27A to control flow of gases to and from the chamber 29 by way of passages 30 as appropriate during rotation of the work station 4 through the packaging stages. The valve block 31 has an exhaust port 34A (which communicates through conduit 34B and the central core 11 with an exhaust outlet 34C) and a gas inlet through port 34 which can communicate under control of the valve 13B'' with nitrogen gas under pressure from the manifold 14A (FIG. 2). The control valve 33 opens and closes communication between the chamber 29 and the exhaust port 34A.

Located within the skirt 25 and forming a part of the head block 24 is a nozzle unit 35 which is received within the open top of the can 1 as the latter is received within the skirt 25. The nozzle unit 35 includes a circumferentially spaced array of fluid passages or nozzles 36 which open at their bottom ends to the interior of the can 1 and at their upper ends open to a valve seating 37 of a beer flow control valve. Passages 38 within the head 24 provide communication between the annular chamber 29 and the interior of a can 1 received within the skirt 25 so that nitrogen gas may flow by way of these passages from the chamber 29 into the can 1 and also be exhausted from the can to the exhaust port 34A. Carried by the head 24 for axial displacement therewith and as part of the nozzle unit 35 is a gas exchange conduit 40 which extends vertically from the head 24 coaxially within the tubular spigot 28 and bore 23 to pass through the bottom wall 8B of the bowl 8 and the reservoir of beer 9 in the bowl and emerge in the bowl headspace 12. The upper end of the gas exchange conduit 40 has a control port 41 which is openable to the headspace 12. The lower end of the conduit 40 has a control port 42 within the nozzle unit 35 and which is normally open but is closable by a ball valve 43. Axially slidable on the gas exchange conduit 40 is a tubular rod or beer valve sleeve 44 on the lower end of which is carried a bell-shaped valve member 45 having an annular seal 46 which forms part of the beer flow control valve and is displaceable into and out of sealing engagement with the annular seating 37 of the nozzle passages 36. The upper end of the beer valve sleeve 44 terminates short of the upper end of the gas exchange conduit 40 and carries an external flange 47. Reacting axially between the flange 47 and a bottom end flange 48 of a tubular cage 49 is a compression spring 50. The cage 49 is formed as part of a gas valve sleeve 51 which is capable of restricted axial sliding movement on the upper end of the gas exchange conduit 40. A compression spring 52 biases the gas valve sleeve 51 axially relative to the flange 47 of the beer valve sleeve 44. The gas valve sleeve 51 is axially displaceable on the conduit 40 and relative to the beer valve sleeve 44 to compress the spring 52 and for the bottom end 53 of the gas valve sleeve to abut the top end 54 of the beer valve sleeve 44. Carried by the gas valve sleeve 51 for axial displacement therewith is a gas valve closure socket 55 which includes a sealing ring 56. By axial displacement of the gas valve sleeve 51 to compress spring 52, the gas valve closure socket 55 is displaced downwardly in FIG. 3 to receive the upper end of the gas exchange conduit 40 whereby the port 41 is closed and sealed by the seal 56. Extending upwardly from the gas valve closure socket 55 and displaceable therewith is a cap 57 having an upper flange 58 and a lower flange 59 by mechanical pressure on which axial displacement of the valve sleeves 51 and 44 may be controlled.

Figure 4:
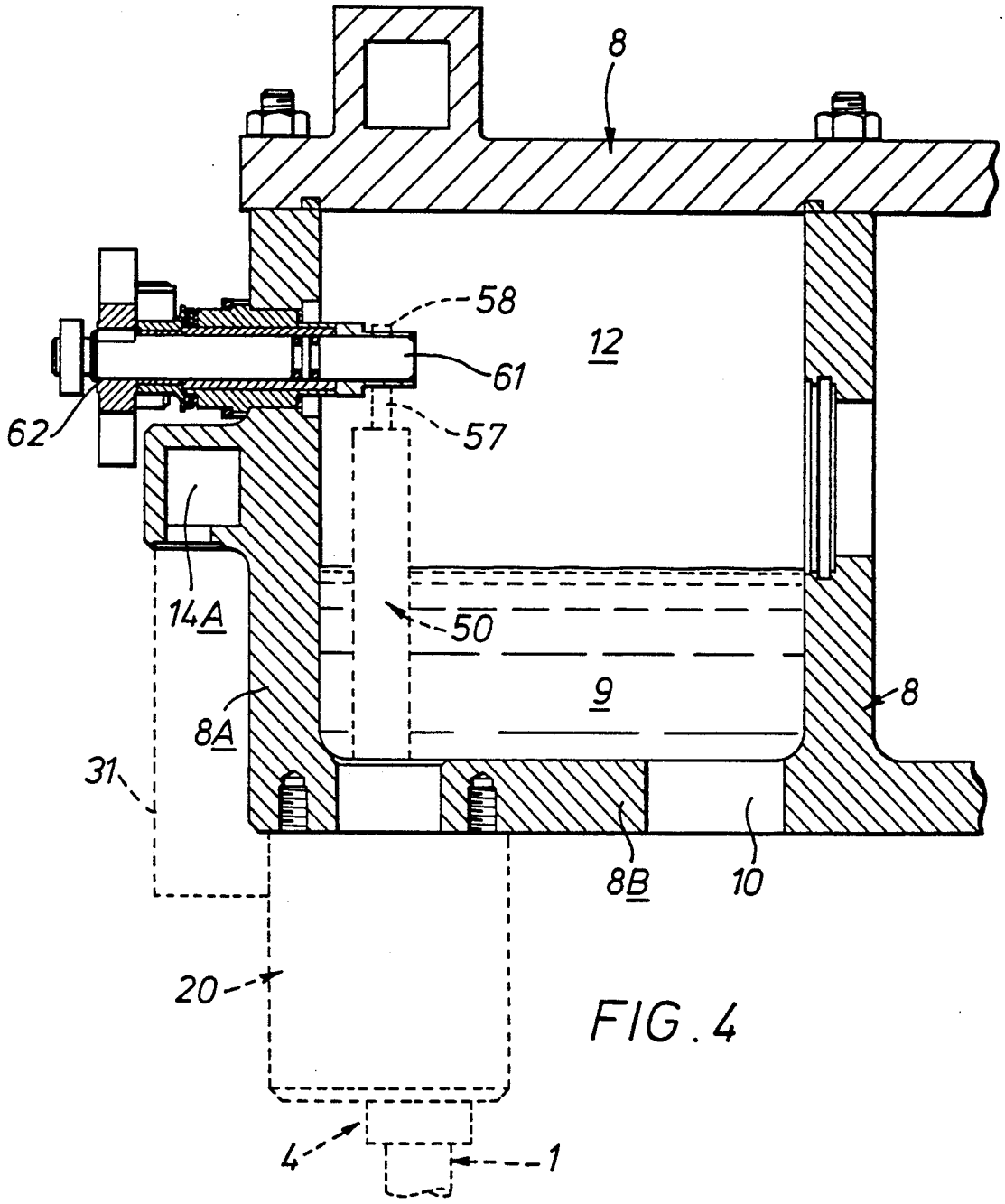
Figure 5:
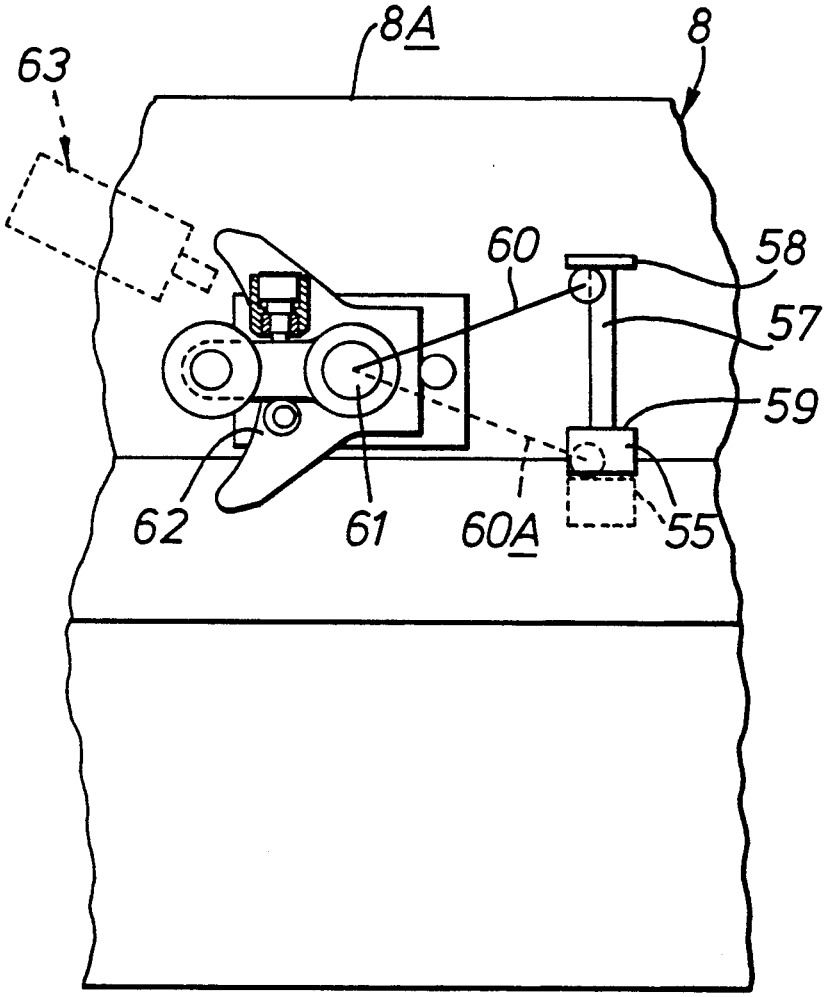

The cap 57 is received within the bifurcated end of a lever indicated at 60 (FIG. 5) which is pivotally mounted by a shaft 61 in the side wall 8A of the bowl 8 (FIG. 4) to be pivotal between the position indicated at 60 and that indicated at 60A in FIG. 5. Pivotal movement of the lever 60 is controlled by a Y-shaped rocking lever 62 externally of the bowl 8—displacement of the rocking lever 62 is controlled by engagement of that lever with local cam shaped actuators relative to which the lever moves during its rotary displacement with the bowl 8 to move the lever 60 downwardly or upwardly in FIG. 5 as appropriate. A fluid pressure operated (in the present example, pneumatic) ram indicated at 63 in FIG. 5 is carried on the side wall 8A of the bowl 8. Actuation of the ram 63 is effected by the control valves 13B' and 13B''' in response to adjustment of those valves by localized actuators relative to which the valves move during its rotary displacement with the bowl 8. Valve 13B' serves to control extension of the ram 63 and valve 13B'''serves to control contraction of the ram 63. By its pivotal movement the lever 60 can act on either the flange 58 or the flange 59 of the cap 57, in the former case to displace the cap 57 upwardly in FIG. 3 and in the latter instance to displace the cap 57 downwardly in FIG. 3. During such displacement of the cap 57 it will be appreciated that corresponding axial displacement is exhibited by the valve closure socket 55, the gas valve sleeve 51 and the cage 49. With lever 60 pivoted downwardly in FIG. 5 to act on the flange 59 and the rocking lever 62 positioned accordingly, the ram 63 can be actuated by its valve 13B' to extend and engage the lever 62 to ensure that the flange 55 is retained, temporarily, in its downwardly displaced position when the lever 62 moves out of engagement with the aforementioned local actuator.

In the condition of the filling head 20 as shown in FIG. 3, the can 1 is received within the skirt 24 with its mouth in sealing engagement with the seal 26 while the nozzle unit 35 is received within the upper part of the can 1 so that the head block 24 is extended on the spigot 22. Furthermore, both the upper and lower ports 41 and 42 of the gas exchange conduit 40 are open for gas in the bowl headspace 12 to communicate with gas in the interior of the can 1 and the beer valve sleeve 44 is withdrawn so that seal 46 opens port 37 to the nozzles 36. As a consequence, beer 9 from the bowl 8 can flow by way of passage 70 in the bottom wall 8B of the bowl 8, the bore 23, through the tubular spigot 28 and the nozzles 36 to enter the can 1 for filling while gas displaced from the can 1 passes by way of the gas exchange conduit 40 and its open ports 41 and 42 to enter the headspace 12 of the bowl. During such filling the pivoted lever 60 (under control of the rocking lever 62 and with the ram 63 inactive) acts on the flange 58 to urge the cap 57 upwardly in FIG. 3 and maintains the port 41 open.

When the can 1 has been charged with a required volume of beverage the ball of valve 43 reacts to close the port 42 of the gas exchange conduit. This reaction of the ball valve is effected automatically as a result of a venturi effect created by the emergent gas flow on the ball of the valve. Upon port 42 being closed a back pressure develops in the headspace of the can 1 causing beer flow through the nozzles 36 to cease. Following or substantially simultaneously with the ball valve 43 closing, the pivoted lever 60 is displaced downwardly in FIG. 3 under control by the rocking lever 62 to engage flange 59 of the cap and displace the gas valve socket 55 downwardly; this causes port 41 of the gas exchange conduit to close as the end 53 of the gas valve sleeve 51 abuts end 54 of the beer valve sleeve 44 to displace the latter sleeve downwardly and thereby close the beer flow control valve as the seal 46 engages the seating 37 of the nozzles. The snift valve 32 in the valve block 31 is now adjusted to vent the headspace in the can 1 direct to atmosphere by way of passages 38, chamber 29 and passages 30 and an exhaust port 32A in the snift valve 32. With the can headspace at atmospheric pressure, the head block 24 is raised under control of the cam track and roller 27 for the skirt 25 and nozzle unit 35 to clear the can 1.

When the headspace of the can is at atmospheric pressure and the port 41 of the gas exchange conduit 40 is closed, it will be appreciated that a considerable pressure differential is applied from the gas pressure in the bowl headspace 12; this pressure differential on the gas valve socket 55 and on the annular seal 46 is adequate to maintain the port 41 and also the valve 46/37 closed. Consequently downward pressure from the pivoted lever 60 on the cap flange 59 can be and is released to permit the gas exchange conduit 40, the beer valve sleeve 44 and the cage 49 to be displaced axially into the bowl 8 as the headblock 24 is raised to clear the can and while the port 41 remains closed.

Figure 2:
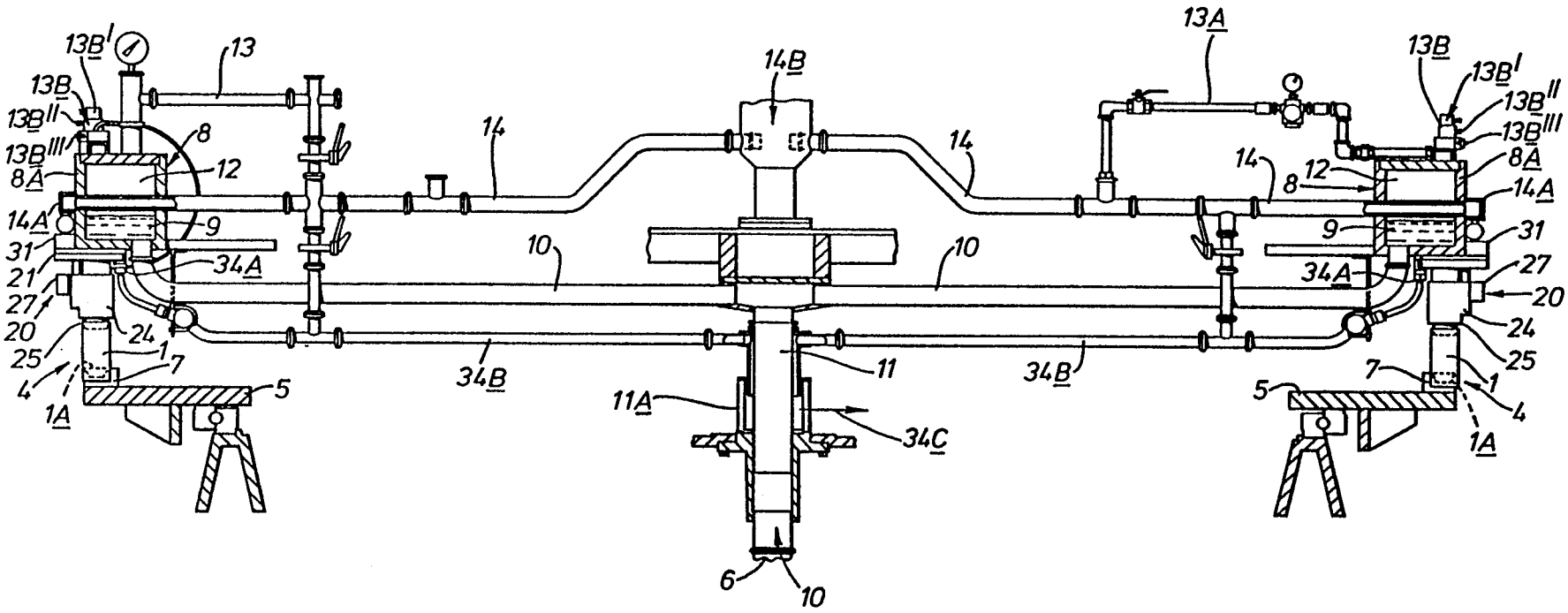

The above described filling of the can 1 and lifting of the head block 24 to clear the charged can occurs as the work station 4 is carried by the rotating platform 5 and bowl 8 over the arcuate region indicated at 80 in FIG. 1. Following charging with beer, the open topped can is displaced from its work station at the position indicated at 81 and on to a conveyor 82 by which it is carried to a seaming station (not shown) where the top of the can is sealed in conventional manner. Immediately prior to sealing the headspace of the can will usually be dosed with liquid nitrogen to displace air therefrom and to pressurize the can contents following sealing.

After releasing its can to the conveyor 82 the work station 4 moves to pick up a fresh can 1 from the star wheel 3 following which the head block 24 is lowered at a position indicated at 83 in FIG. 1 to engage the open top of the can while the beer flow control valve assembly 37/46 and port 41 are closed. As the filling station is moved through the arcuate region indicated at 85 and with the head block 24 sealed to the open top of the can, the exhaust valve 33 in the valve block is adjusted and the Y shaped lever 62 is actuated to open port 41 to flush nitrogen gas derived from the bowl headspace 12 by way of the gas exchange conduit 40, through the interior of the can and directly to atmospheric pressure at the exhaust 34C to purge or flush air from the primary chamber of the can.

This purging with the interior of the can open to atmospheric pressure has negligible effect on the air within the hollow insert 1A of the can because of the restricted orifice between its primary and secondary chambers.

Following such initial purging the pivoted lever 60 is adjusted by control of the rocking lever 62 to engage and bear down on the cap flange 59 (as shown at 60A in FIG. 5) and the ram 63 is actuated by valve 13B' to extend and retain the rocking lever 62 in its so adjusted position at the stage when the filling station reaches the position indicated at 86 in FIG. 1. The gas exchange port 41 of the gas valve 55 to the conduit 40 and beer flow control valve assembly 37/46 are thereby retained closed. With these latter valves firmly retained in their closed condition by the lever 60, control valve 13B'' is actuated to admit nitrogen gas under pressure from the conduit 14 and by way of the through port 34 in the valve block 31 into the interior of the can 1 to pressurize the can to greater than atmospheric pressure, say, approximately 4 bar. This pressurization is effected as the filling station is displaced over the arcuate region indicated at 87. Following pressurization the exhaust valve 33 is controlled to open the interior of the can to communication with atmospheric pressure at the exhaust port 34A as the work station passes through the arcuate region indicated at 88. As the mixed gases, particularly in the secondary chamber of the insert 1A, exhaust and reduce to approximately atmospheric pressure over the region 88, the percentage of atmospheric oxygen originally present in the container, particularly its hollow insert, is reduced by the dilution effect of the nitrogen gas. Following the initial pressurization and exhaust stages 87 and 88, the valves 13B" and 33 are adjusted as the work station is carried by the rotating platform and bowl for the interior of the can 1 to be subjected successively and sequentially to second pressurization and exhaustion stages indicated at 87A, 88A respectively and third pressurization and exhaustion stages indicated at 87B and 88B respectively. By such cyclic pressurization to 4 bar and exhaustion to atmospheric pressure of the can interior, the atmospheric oxygen contained within the can 1, especially its hollow insert, is progressively diluted to a predetermined percentage by volume of the gases within the can. This percentage is determined so that the oxygen content has negligible effect on the characteristics of the beer which is to be packaged in the sealed can over a required shelf life of, say, approximately twelve months. Preferably the oxygen content will be less than 0.4 milligrammes per liter.

The exhausting of the can may be assisted, for example by an extractor fan to ensure that a pressure near atmospheric is reached and to remove nitrogen gas from the working environment.

As previously discussed the interior of the can 1 is pressurized with nitrogen gas during the stages 87, 87A and 87B to approximately 4 bar which is considerably greater than the 2 bar pressure in the headspace 12 of the bowl 8. However, the pivoted lever 60 bearing on the cap flange 59 firmly retains the gas exchange conduit port 41 closed together with the beer flow control valve assembly 37/46 to ensure that the high pressure nitrogen gas in the can does not lift the gas valve socket 55 to open port 41 for such high pressure gas to enter the bowl headspace 12 by way of the gas exchange conduit and does not lift the seal 46 from its seating 37 for high pressure gas in the can to bubble through the column of beer in the tubular spigot 28 and bore 23 to emerge in the reservoir of beer 9 in the bowl—either of such events creating an imbalance in the fluid system of the bowl and reducing the pressurization of the can.

Following the exhaustion stage 88B and prior to the filling station entering the arcuate region 80 of FIG. 1 and with the interior of the can substantially at atmospheric pressure, the ram 63 is retracted and the pivoted lever 60 is adjusted by its control lever 62 to engage and lift the cap 57 in FIG. 3. The gas valve socket 55 together with the sleeve 51 and cage 49 are thus raised relative to the gas exchange conduit 40 and the beer valve sleeve 44 to open port 41 of the gas exchange conduit. Raising of the cage 49 compresses spring 50 which biases the beer valve sleeve 44 upwardly but such biasing force of the spring is inadequate to raise the sleeve 44 and thereby lift the seal 46 from its seating 37 against the pressure differential between the atmospheric pressure within the can and the pressure on the bell shaped valve member 45 exerted by the column of beer on the seal 46 together with the 2 bar pressure in the headspace 12. However, with the port 41 open nitrogen gas under pressure from the bowl headspace 12 flows into the can 1 to equalize the gas pressure in the can and in the headspace 12 at approximately 2 bar. Following such pressure equalization the pressure exerted by the spring 50 against the cage 49 and on the flange 47 is adequate to lift the beer valve sleeve 44 against the pressure exerted by the column of beer and thereby raise the seal 46 from its seating 37. The beer flow control valve is thus opened and beer flows into the can 1 as previously described during movement of the work station 4 through the region 80 of FIG. 1.

It will be realized that although three pressurization stages 87, 87A, 87B and exhaustion stages 88, 88A, 88B have been described, the number of such stages can be increased or decreased as appropriate for achieving the required oxygen dilution. It is a particular feature of the invention that throughout the pressurization stages 87, 87A and 87B, the exterior of the can 1 is at atmospheric pressure, unlike our prior proposal in which the can 1 is exhausted to sub-atmospheric pressure and housed within a pressure chamber to alleviate collapse of the can. The omission of such pressure chambers from the array of work stations 4 permits a larger number of work stations to be provided on a given sized rotating platform and bowl as compared with the prior proposal. In the above described preferred embodiment 120 work stations are provided whereas in a similarly sized rotary platform in which the filling heads each have an associated pressure chamber for accommodating the can there are, typically, 60 work stations. From this it will be appreciated that with the relatively larger number of work stations which can be provided by the apparatus of the present invention for a given sized rotary filling unit, it is possible to achieve a far higher throughput rate at which the cans are fed to the work stations from the conveyor 2 and conveyed to the sealing station by the conveyor 82.

I claim:

1. A method of packaging a beverage in a container having a primary chamber and a relatively smaller secondary chamber which communicates with the primary chamber by way of a restricted orifice which comprises the successive steps of:

(a) subjecting the interior of the container and thereby the primary and secondary chambers to a pressure greater than atmospheric pressure by admission thereto of a non-oxidizing gas, (b) reducing the pressure of gases in the interior of the container to substantially atmospheric pressure to dilute the atmospheric oxygen content within the primary and secondary chambers to a predetermined percentage by volume of the gases within the container and which oxygen content is substantially negligible in its effect, if any, on the beverage which is to be sealed in the container, (c) charging the interior of the container with said beverage and (d) sealing the container to provide a beverage package; and which further comprises throughout said steps maintaining the exterior of the container at atmospheric pressure and the interior of the container at not less than atmospheric pressure.

2. A method as claimed in claim 1 which comprises successively and sequentially repeating steps (a) and (b) at least once prior to step (c) to progressively dilute the atmospheric oxygen content within the primary and secondary chambers to said predetermined percentage.

3. A method as claimed in claim 1 which comprises, prior to step (a), subjecting the interior of the container to flushing with said non-oxidizing gas at a pressure greater than atmospheric during which the interior and exterior of the container are open to atmospheric pressure.

4. A method as claimed in claim 1 which comprises effecting steps (a), (b) and (c) through a beverage filling head which sealingly engages an open top of the container.

5. A method as claimed in claim 4 which comprises charging the container with beverage through said filling head subsequent to the evacuation of the interior of the container effected by step (b).

6. A method as claimed in claim 4 in which beverage for flow by way of the filling head into the container is derived from a bowl or reservoir and valve means is provided which controls fluid flow communication between said bowl or reservoir and the primary chamber of the container and which comprises retaining said valve means in a condition to close said communication at least during the pressurization stage (a) to prevent high pressure non-oxidizing gas in the container from entering fluid in the bowl or reservoir.

7. Apparatus for packaging a beverage in a container having in its interior a primary chamber and a relatively smaller secondary chamber which communicates with the primary chamber by way of a restricted orifice; said apparatus comprising a work station for mounting an open mouth container with the interior and exterior of the container at atmospheric pressure; a filing head comprising nozzle means through which the container is to be charged with beverage and which head is displaceable relative to the container into sealing engagement with the mouth of the container to communicate with the interior thereof while the exterior of the container is maintained exposed to atmospheric pressure; gas control means by which a non-oxidizing gas is admitted at a pressure greater than atmospheric pressure through said head into the interior of the container; means controlling gas flow from the interior of the container through said head for reducing the pressure of gases within the primary and secondary chambers of said container from said pressure greater than atmospheric to not less than atmospheric pressure whereby the oxygen content within the primary and secondary chambers from its original atmosphere is reduced to a predetermined percentage by volume of the gases within the primary and secondary chambers of the container for said oxygen content to be substantially negligible to its effect, if any, on the beverage which is to be packaged in the container.

8. Apparatus as claimed in claim 7 and comprising control means for successively and sequentially admitting said non-oxidizing gas to the interior of the container at a pressure greater than atmospheric and evacuating or exhausting the primary and secondary chambers to reduce the gas provided therein from said pressure greater than atmospheric to not less than atmospheric pressure to progressively reduce the oxygen content within the primary and secondary chambers to said predetermined percentage.

9. Apparatus as claimed in claim 7 in which the filling head derives beverage from a reservoir having a headspace containing said non-oxidizing gas at a pressure greater than atmospheric.

10. Apparatus as claimed in claim 9 and comprising passage means through which fluid flow communication is provided between the reservoir and the nozzle means, said passage means having valve means which opens and closes said communication and wherein retaining means is provided by which said valve means is retained to close said communication at least during pressurization of the container with said non-oxidizing gas to a pressure greater than atmospheric pressure.

11. Apparatus as claimed in claim 10 in which the passage means comprises a gas exchange conduit which provides communication between the interior of the container and the headspace of the reservoir and the valve means is responsive to the retaining means to maintain communication through the gas exchange conduit closed during said pressurization of the container to prevent high pressure gas in the container from flowing to the headspace of the reservoir.

12. Apparatus as claimed in claim 10 in which the passage means comprises a beverage conduit through which beverage flows from the reservoir to the primary chamber of the container and the retaining means acts on the valve means to maintain the beverage conduit closed during said pressurization of the container to prevent high pressure gas in the container from passing through the beverage conduit to enter beverage in the bowl or reservoir.

13. Apparatus as claimed in claim 10 in which a seat is provided for receiving the container at the work station and said seat is displaced in unison with the filling head and wherein said gas control means, said means controlling evacuation of the interior of the container and said retaining means are actuated automatically during and at predetermined stages of said displacement.

14. Apparatus as claimed in claim 10 in which the valve means has a part thereof extending into the headspace of the reservoir and said part is displaced by displacement of a lever within the headspace of the bowl or reservoir for controlling the valve means, and wherein said lever comprises the retaining means and is controlled in its displacement externally of the bowl or reservoir.

15. Apparatus as claimed in claim 7 in which the container is accommodated by a seat and displaced thereby during said gas pressurization, evacuation and beverage charging and during said displacement the seat is maintained in a substantially horizontal plane and wherein the filling head comprises a head block having the nozzle means which is raised to provide clearance for the container to be moved on to or off its seat and is lowered to provide said sealing engagement with the mouth of the container.

16. Apparatus as claimed in claim 15 and comprising a circumferentially disposed array of seats provided on the substantially horizontal rotatable platform and onto which seats open topped containers are to be fed successively by conveyor means, a circumferentially spaced array of filling heads associated one with each seat to overlie the container on the respective seat and means for controlling vertical displacement of the head blocks of the respective filling heads to move them vertically into or out of engagement with the open tops of the containers on the respective seats.

* * * * *

UNITED STATES PATENT AND TRADEMARK OFFICE

CERTIFICATE OF CORRECTION

PATENT NO. : 5,329,963

DATED : July 19, 1994

INVENTOR(S) : Jones et al.

It is certified that error appears in the above-identified patent and that said Letters Patent is hereby corrected as shown below:

Title page item [30] "Foreign Application Priority Data":

Please delete "9121375" and substitute--9121375.1--.

Signed and Sealed this

Eleventh Day of October, 1994

*Attest:*

*Attesting Officer*

Bruce Lehman

BRUCE LEHMAN

*Commissioner of Patents and Trademarks*